US007119686B2

(12) United States Patent
Bertness et al.

(10) Patent No.: US 7,119,686 B2
(45) Date of Patent: Oct. 10, 2006

(54) THEFT PREVENTION DEVICE FOR AUTOMOTIVE VEHICLE SERVICE CENTERS

(75) Inventors: Kevin I. Bertness, Batavia, IL (US); J. David Vonderhaar, Bolingbrook, IL (US)

(73) Assignee: Midtronics, Inc., Willowbrook, IL (US)

( * ) Notice: Subject to any disclaimer, the term of this patent is extended or adjusted under 35 U.S.C. 154(b) by 126 days.

(21) Appl. No.: 10/823,140

(22) Filed: Apr. 13, 2004

(65) Prior Publication Data

US 2005/0225446 A1 Oct. 13, 2005

(51) Int. Cl.
*G08B 13/14* (2006.01)

(52) U.S. Cl. ..... 340/572.1; 340/5.2; 340/568.1; 235/385

(58) Field of Classification Search ..... 340/572.1, 340/573.4, 573.1, 5.2, 568.1, 571, 328, 686.6; 235/385

See application file for complete search history.

(56) References Cited

U.S. PATENT DOCUMENTS

| | | | | |
|---|---|---|---|---|
| 2,000,665 | A | 5/1935 | Neal | 173/324 |
| 2,514,745 | A | 7/1950 | Dalzell | 171/95 |
| 3,356,936 | A | 12/1967 | Smith | 324/29.5 |
| 3,562,634 | A | 2/1971 | Latner | 31/4 |
| 3,593,099 | A | 7/1971 | Scholl | 320/13 |
| 3,607,673 | A | 9/1971 | Seyl | 204/1 |
| 3,652,341 | A | 3/1972 | Halsall et al. | 136/176 |
| 3,676,770 | A | 7/1972 | Sharaf et al. | 324/29.5 |
| 3,729,989 | A | 5/1973 | Little | 73/133 |
| 3,750,011 | A | 7/1973 | Kreps | 324/29.5 |
| 3,753,094 | A | 8/1973 | Furuishi et al. | 324/29.5 |
| 3,796,124 | A | 3/1974 | Crosa | 85/36 |
| 3,808,522 | A | 4/1974 | Sharaf | 324/29.5 |
| 3,811,089 | A | 5/1974 | Strezelewicz | 324/170 |
| 3,873,911 | A | 3/1975 | Champlin | 324/29.5 |
| 3,876,931 | A | 4/1975 | Godshalk | 324/29.5 |
| 3,886,443 | A | 5/1975 | Miyakawa et al. | 324/29.5 |
| 3,889,248 | A | 6/1975 | Ritter | 340/249 |
| 3,906,329 | A | 9/1975 | Bader | 320/44 |
| 3,909,708 | A | 9/1975 | Champlin | 324/29.5 |
| 3,936,744 | A | 2/1976 | Perlmutter | 324/158 |
| 3,946,299 | A | 3/1976 | Christianson et al. | 320/43 |
| 3,947,757 | A | 3/1976 | Grube et al. | 324/28 |
| 3,969,667 | A | 7/1976 | McWilliams | 324/29.5 |
| 3,979,664 | A | 9/1976 | Harris | 324/17 |
| 3,984,762 | A | 10/1976 | Dowgiallo, Jr. | 324/29.5 |
| 3,984,768 | A | 10/1976 | Staples | 324/62 |
| 3,989,544 | A | 11/1976 | Santo | 429/65 |

(Continued)

FOREIGN PATENT DOCUMENTS

DE 29 26 716 B1 1/1981

(Continued)

OTHER PUBLICATIONS

"Dynamic modelling of lead/acid batteries using impedance spectroscopy for parameter identification", Journal of Power Sources, pp. 69-84, (1997).

(Continued)

*Primary Examiner*—Anh V. La
(74) *Attorney, Agent, or Firm*—Leanne R. Taveggia; Westman, Champlin & Kelly, P.A.

(57) ABSTRACT

An apparatus and method for preventing theft in automotive vehicle service centers. A transmitter transmits a wireless security signal which defines a perimeter. At least one portable tool for use in automotive vehicle service centers includes a receiver configured to receive a transmitted security signal. Security circuitry is actuated if the tool is outside the perimeter defined by the security signal.

21 Claims, 4 Drawing Sheets

U.S. PATENT DOCUMENTS

| | | | | |
|---|---|---|---|---|
| 4,008,619 | A | 2/1977 | Alcaide et al. | 73/398 |
| 4,023,882 | A | 5/1977 | Pettersson | 339/96 |
| 4,024,953 | A | 5/1977 | Nailor, III | 206/344 |
| 4,047,091 | A | 9/1977 | Hutchines et al. | 363/59 |
| 4,053,824 | A | 10/1977 | Dupuis et al. | 324/29.5 |
| 4,056,764 | A | 11/1977 | Endo et al. | 320/3 |
| 4,070,624 | A | 1/1978 | Taylor | 327/158 |
| 4,086,531 | A | 4/1978 | Bernier | 324/158 |
| 4,112,351 | A | 9/1978 | Back et al. | 324/16 |
| 4,114,083 | A | 9/1978 | Benham et al. | 320/39 |
| 4,126,874 | A | 11/1978 | Suzuki et al. | 354/60 |
| 4,160,916 | A | 7/1979 | Papasideris | 307/10 |
| 4,178,546 | A | 12/1979 | Hulls et al. | 324/158 |
| 4,193,025 | A | 3/1980 | Frailing et al. | 324/427 |
| 4,207,611 | A | 6/1980 | Gordon | 364/580 |
| 4,217,645 | A | 8/1980 | Barry et al. | 364/483 |
| 4,280,457 | A | 7/1981 | Bloxham | 123/198 |
| 4,297,639 | A | 10/1981 | Branham | 324/429 |
| 4,315,204 | A | 2/1982 | Sievers et al. | 322/28 |
| 4,316,185 | A | 2/1982 | Watrous et al. | 340/636 |
| 4,322,685 | A | 3/1982 | Frailing et al. | 324/429 |
| 4,351,405 | A | 9/1982 | Fields et al. | 180/65 |
| 4,352,067 | A | 9/1982 | Ottone | 324/434 |
| 4,360,780 | A | 11/1982 | Skutch, Jr. | 324/437 |
| 4,361,809 | A | 11/1982 | Bil et al. | 324/426 |
| 4,363,407 | A | 12/1982 | Barkler et al. | 209/3.3 |
| 4,369,407 | A | 1/1983 | Korbell | 324/416 |
| 4,379,989 | A | 4/1983 | Kurz et al. | 320/26 |
| 4,379,990 | A | 4/1983 | Sievers et al. | 322/99 |
| 4,385,269 | A | 5/1983 | Aspinwall et al. | 320/14 |
| 4,390,828 | A | 6/1983 | Converse et al. | 320/32 |
| 4,392,101 | A | 7/1983 | Saar et al. | 320/20 |
| 4,396,880 | A | 8/1983 | Windebank | 320/21 |
| 4,408,157 | A | 10/1983 | Beaubien | 324/62 |
| 4,412,169 | A | 10/1983 | Dell'Orto | 320/64 |
| 4,423,378 | A | 12/1983 | Marino et al. | 324/427 |
| 4,423,379 | A | 12/1983 | Jacobs et al. | 324/429 |
| 4,424,491 | A | 1/1984 | Bobbett et al. | 324/433 |
| 4,459,548 | A | 7/1984 | Lentz et al. | 324/158 |
| 4,462,022 | A | 7/1984 | Stolarczyk | 340/506 |
| 4,514,694 | A | 4/1985 | Finger | 324/429 |
| 4,520,353 | A | 5/1985 | McAuliffe | 340/636 |
| 4,564,798 | A | 1/1986 | Young | 320/6 |
| 4,620,767 | A | 11/1986 | Woolf | 339/255 |
| 4,633,418 | A | 12/1986 | Bishop | 364/554 |
| 4,659,977 | A | 4/1987 | Kissel et al. | 320/64 |
| 4,663,580 | A | 5/1987 | Wortman | 320/35 |
| 4,665,370 | A | 5/1987 | Holland | 324/429 |
| 4,667,143 | A | 5/1987 | Cooper et al. | 320/22 |
| 4,667,279 | A | 5/1987 | Maier | 363/46 |
| 4,678,998 | A | 7/1987 | Muramatsu | 324/427 |
| 4,679,000 | A | 7/1987 | Clark | 324/428 |
| 4,680,528 | A | 7/1987 | Mikami et al. | 320/32 |
| 4,686,442 | A | 8/1987 | Radomski | 320/17 |
| 4,697,134 | A | 9/1987 | Burkum et al. | 320/48 |
| 4,707,795 | A | 11/1987 | Alber et al. | 364/550 |
| 4,709,202 | A | 11/1987 | Koenck et al. | 320/43 |
| 4,710,861 | A | 12/1987 | Kanner | 363/46 |
| 4,719,428 | A | 1/1988 | Liebermann | 324/436 |
| 4,723,656 | A | 2/1988 | Kiernan et al. | 206/705 |
| 4,743,855 | A | 5/1988 | Randin et al. | 324/430 |
| 4,745,349 | A | 5/1988 | Palanisamy et al. | 320/22 |
| 4,816,768 | A | 3/1989 | Champlin | 324/428 |
| 4,820,966 | A | 4/1989 | Fridman | 320/32 |
| 4,825,170 | A | 4/1989 | Champlin | 324/436 |
| 4,847,547 | A | 7/1989 | Eng, Jr. et al. | 320/35 |
| 4,849,700 | A | 7/1989 | Morioka et al. | 324/427 |
| 4,874,679 | A | 10/1989 | Miyagawa | 429/91 |
| 4,876,495 | A | 10/1989 | Palanisamy et al. | 320/18 |
| 4,881,038 | A | 11/1989 | Champlin | 324/426 |
| 4,888,716 | A | 12/1989 | Ueno | 364/550 |
| 4,912,416 | A | 3/1990 | Champlin | 324/430 |
| 4,913,116 | A | 4/1990 | Katogi et al. | 123/425 |
| 4,926,330 | A | 5/1990 | Abe et al. | 364/424.03 |
| 4,929,931 | A | 5/1990 | McCuen | 340/636 |
| 4,931,738 | A | 6/1990 | MacIntyre et al. | 324/435 |
| 4,933,845 | A | 6/1990 | Hayes | 364/200 |
| 4,934,957 | A | 6/1990 | Bellusci | 439/504 |
| 4,937,528 | A | 6/1990 | Palanisamy | 324/430 |
| 4,947,124 | A | 8/1990 | Hauser | 324/430 |
| 4,949,046 | A | 8/1990 | Seyfang | 324/427 |
| 4,956,597 | A | 9/1990 | Heavey et al. | 320/14 |
| 4,968,941 | A | 11/1990 | Rogers | 324/428 |
| 4,968,942 | A | 11/1990 | Palanisamy | 324/430 |
| 4,993,059 | A | 2/1991 | Smith et al. | 379/39 |
| 5,004,979 | A | 4/1991 | Marino et al. | 324/160 |
| 5,032,825 | A | 7/1991 | Xuznicki | 340/636 |
| 5,037,778 | A | 8/1991 | Stark et al. | 437/216 |
| 5,047,722 | A | 9/1991 | Wurst et al. | 324/430 |
| 5,081,565 | A | 1/1992 | Nabha et al. | 362/465 |
| 5,087,881 | A | 2/1992 | Peacock | 324/378 |
| 5,095,223 | A | 3/1992 | Thomas | 307/110 |
| 5,108,320 | A | 4/1992 | Kimber | 439/883 |
| 5,126,675 | A | 6/1992 | Yang | 324/435 |
| 5,130,658 | A * | 7/1992 | Bohmer | 324/435 |
| 5,140,269 | A | 8/1992 | Champlin | 324/433 |
| 5,144,218 | A | 9/1992 | Bosscha | 320/44 |
| 5,144,248 | A | 9/1992 | Alexandres et al. | 324/428 |
| 5,159,272 | A | 10/1992 | Rao et al. | 324/429 |
| 5,160,881 | A | 11/1992 | Schramm et al. | 322/7 |
| 5,170,124 | A | 12/1992 | Blair et al. | 324/434 |
| 5,179,335 | A | 1/1993 | Nor | 320/21 |
| 5,194,799 | A | 3/1993 | Tomantschger | 320/2 |
| 5,204,611 | A | 4/1993 | Nor et al. | 320/21 |
| 5,214,370 | A | 5/1993 | Harm et al. | 320/35 |
| 5,214,385 | A | 5/1993 | Gabriel et al. | 324/434 |
| 5,241,275 | A | 8/1993 | Fang | 324/430 |
| 5,254,952 | A | 10/1993 | Salley et al. | 324/429 |
| 5,266,880 | A | 11/1993 | Newland | 320/14 |
| 5,281,919 | A | 1/1994 | Palanisamy | 324/427 |
| 5,281,920 | A | 1/1994 | Wurst | 324/430 |
| 5,295,078 | A | 3/1994 | Stich et al. | 364/483 |
| 5,298,797 | A | 3/1994 | Redl | 307/246 |
| 5,300,874 | A | 4/1994 | Shimamoto et al. | 320/15 |
| 5,302,902 | A | 4/1994 | Groehl | 324/434 |
| 5,313,152 | A | 5/1994 | Wozniak et al. | 320/118 |
| 5,315,287 | A | 5/1994 | Sol | 340/455 |
| 5,321,626 | A | 6/1994 | Palladino | 364/483 |
| 5,321,627 | A | 6/1994 | Reher | 364/483 |
| 5,323,337 | A | 6/1994 | Wilson et al. | 364/574 |
| 5,325,041 | A | 6/1994 | Briggs | 320/44 |
| 5,331,268 | A | 7/1994 | Patino et al. | 320/20 |
| 5,336,993 | A | 8/1994 | Thomas et al. | 324/158.1 |
| 5,338,515 | A | 8/1994 | Dalla Betta et al. | 422/95 |
| 5,339,018 | A | 8/1994 | Brokaw | 320/35 |
| 5,343,380 | A | 8/1994 | Champlin | 363/46 |
| 5,347,163 | A | 9/1994 | Yoshimura | 307/66 |
| 5,352,968 | A | 10/1994 | Reni et al. | 320/35 |
| 5,365,160 | A | 11/1994 | Leppo et al. | 320/22 |
| 5,365,453 | A | 11/1994 | Startup et al. | 364/481 |
| 5,369,364 | A | 11/1994 | Renirie et al. | 324/430 |
| 5,381,096 | A | 1/1995 | Hirzel | 324/427 |
| 5,410,754 | A | 4/1995 | Klotzbach et al. | 370/85.13 |
| 5,412,308 | A | 5/1995 | Brown | 323/267 |
| 5,412,323 | A | 5/1995 | Kato et al. | 324/429 |
| 5,426,371 | A | 6/1995 | Salley et al. | 324/429 |
| 5,426,416 | A | 6/1995 | Jefferies et al. | 340/664 |
| 5,432,025 | A | 7/1995 | Cox | 429/65 |
| 5,432,426 | A | 7/1995 | Yoshida | 320/20 |
| 5,434,495 | A | 7/1995 | Toko | 320/44 |
| 5,435,185 | A | 7/1995 | Eagan | 73/587 |
| 5,442,274 | A | 8/1995 | Tamai | 320/23 |
| 5,445,026 | A | 8/1995 | Eagan | 73/591 |
| 5,449,996 | A | 9/1995 | Matsumoto et al. | 320/20 |

5,449,997 A 9/1995 Gilmore et al. ..... 320/39
5,451,881 A 9/1995 Finger ..... 324/433
5,453,027 A 9/1995 Buell et al. ..... 439/433
5,457,377 A 10/1995 Jonsson ..... 320/5
5,469,043 A 11/1995 Cherng et al. ..... 320/31
5,485,090 A 1/1996 Stephens ..... 324/433
5,488,300 A 1/1996 Jamieson ..... 324/432
5,519,383 A 5/1996 De La Rosa ..... 340/636
5,528,148 A 6/1996 Rogers ..... 324/426
5,537,967 A 7/1996 Tashiro et al. ..... 123/792.1
5,541,489 A 7/1996 Dunstan ..... 320/2
5,546,317 A 8/1996 Andrieu ..... 364/481
5,548,273 A 8/1996 Nicol et al. ..... 340/439
5,550,485 A 8/1996 Falk ..... 324/772
5,561,380 A 10/1996 Sway-Tin et al. ..... 324/509
5,562,501 A 10/1996 Kinoshita et al. ..... 439/852
5,563,496 A 10/1996 McClure ..... 320/48
5,572,136 A 11/1996 Champlin ..... 324/426
5,574,355 A 11/1996 McShane et al. ..... 320/39
5,578,915 A 11/1996 Crouch, Jr. et al. ..... 320/48
5,583,416 A 12/1996 Klang ..... 320/22
5,585,728 A 12/1996 Champlin ..... 324/427
5,589,757 A 12/1996 Klang ..... 320/22
5,592,093 A 1/1997 Klingbiel ..... 324/426
5,592,094 A 1/1997 Ichikawa ..... 324/427
5,594,740 A 1/1997 LaDue ..... 379/59
5,596,260 A 1/1997 Moravec et al. ..... 320/30
5,598,098 A 1/1997 Champlin ..... 324/430
5,602,462 A 2/1997 Stich et al. ..... 323/258
5,606,242 A 2/1997 Hull et al. ..... 320/48
5,614,788 A 3/1997 Mullins et al. ..... 315/82
5,621,298 A 4/1997 Harvey ..... 320/5
5,633,985 A 5/1997 Severson et al. ..... 395/2.76
5,637,978 A 6/1997 Kellett et al. ..... 320/2
5,642,031 A 6/1997 Brotto ..... 320/21
5,650,937 A 7/1997 Bounaga ..... 364/483
5,652,501 A 7/1997 McClure et al. ..... 320/17
5,653,659 A 8/1997 Kunibe et al. ..... 477/111
5,654,623 A 8/1997 Shiga et al. ..... 320/48
5,656,920 A 8/1997 Cherng et al. ..... 320/31
5,661,368 A 8/1997 Deol et al. ..... 315/82
5,675,234 A 10/1997 Greene ..... 320/15
5,677,077 A 10/1997 Faulk ..... 429/90
5,699,050 A 12/1997 Kanazawa ..... 340/636
5,701,089 A 12/1997 Perkins ..... 327/772
5,705,929 A 1/1998 Caravello et al. ..... 324/430
5,707,015 A 1/1998 Guthrie ..... 241/120
5,710,503 A 1/1998 Sideris et al. ..... 320/6
5,711,648 A 1/1998 Hammerslag ..... 414/786
5,717,336 A 2/1998 Basell et al. ..... 324/430
5,717,937 A 2/1998 Fritz ..... 395/750.01
5,739,667 A 4/1998 Matsuda et al. ..... 320/5
5,745,044 A 4/1998 Hyatt, Jr. et al. ..... 340/825.31
5,747,909 A 5/1998 Syverson et al. ..... 310/156
5,747,967 A 5/1998 Muljadi et al. ..... 320/39
5,754,417 A 5/1998 Nicollini ..... 363/60
5,757,192 A 5/1998 McShane et al. ..... 324/427
5,760,587 A 6/1998 Harvey ..... 324/434
5,772,468 A 6/1998 Kowalski et al. ..... 439/506
5,773,978 A 6/1998 Becker ..... 324/430
5,780,974 A 7/1998 Pabla et al. ..... 315/82
5,780,980 A 7/1998 Naito ..... 318/139
5,789,899 A 8/1998 van Phuoc et al. ..... 320/30
5,793,359 A 8/1998 Ushikubo ..... 345/169
5,796,239 A 8/1998 van Phuoc et al. ..... 320/107
5,805,063 A 9/1998 Kackman ..... 340/539
5,808,469 A 9/1998 Kopera ..... 324/43.4
5,818,234 A 10/1998 McKinnon ..... 324/433
5,821,756 A 10/1998 McShane et al. ..... 324/430
5,821,757 A 10/1998 Alvarez et al. ..... 324/434
5,825,174 A 10/1998 Parker ..... 324/106
5,831,435 A 11/1998 Troy ..... 324/426
5,850,113 A 12/1998 Weimer et al. ..... 307/125
5,862,515 A 1/1999 Kobayashi et al. ..... 702/63
5,865,638 A 2/1999 Trafton ..... 439/288
5,872,443 A 2/1999 Williamson ..... 320/21
5,872,453 A 2/1999 Shimoyama et al. ..... 324/431
5,895,440 A 4/1999 Proctor et al. ..... 702/63
5,912,534 A 6/1999 Benedict ..... 315/82
5,914,605 A 6/1999 Bertness ..... 324/430
5,927,938 A 7/1999 Hammerslag ..... 414/809
5,929,609 A 7/1999 Joy et al. ..... 322/25
5,939,855 A 8/1999 Proctor et al. ..... 320/104
5,939,861 A 8/1999 Joko et al.
5,942,984 A 8/1999 Toms et al. ..... 340/825.07
5,945,829 A 8/1999 Bertness ..... 324/430
5,951,229 A 9/1999 Hammerslag ..... 414/398
5,961,561 A 10/1999 Wakefield, II ..... 701/29
5,961,604 A 10/1999 Anderson et al. ..... 709/229
5,969,625 A 10/1999 Russo ..... 340/636
5,978,805 A 11/1999 Carson ..... 707/10
5,982,138 A 11/1999 Krieger ..... 320/105
6,002,238 A 12/1999 Champlin ..... 320/134
6,005,759 A 12/1999 Hart et al. ..... 361/66
6,008,652 A 12/1999 Theofanopoulos et al. . 324/434
6,009,369 A 12/1999 Boisvert et al. ..... 701/99
6,016,047 A 1/2000 Notten et al. ..... 320/137
6,031,354 A 2/2000 Wiley et al. ..... 320/116
6,031,368 A 2/2000 Klippel et al. ..... 324/133
6,037,751 A 3/2000 Klang ..... 320/160
6,037,777 A 3/2000 Champlin ..... 324/430
6,037,778 A 3/2000 Makhija ..... 324/433
6,046,514 A 4/2000 Rouillard et al. ..... 307/77
6,051,976 A 4/2000 Bertness ..... 324/426
6,055,468 A 4/2000 Kaman et al. ..... 701/29
6,061,638 A 5/2000 Joyce ..... 702/63
6,064,372 A 5/2000 Kahkoska ..... 345/173
6,072,299 A 6/2000 Kurie et al. ..... 320/112
6,072,300 A 6/2000 Tsuji ..... 320/116
6,081,098 A 6/2000 Bertness et al. ..... 320/134
6,081,109 A 6/2000 Seymour et al. ..... 324/127
6,091,238 A 7/2000 McDermott ..... 324/207.2
6,091,245 A 7/2000 Bertness ..... 324/426
6,094,033 A 7/2000 Ding et al. ..... 320/132
6,104,167 A 8/2000 Bertness et al. ..... 320/132
6,114,834 A 9/2000 Parise ..... 320/109
6,137,269 A 10/2000 Champlin ..... 320/150
6,140,797 A 10/2000 Dunn ..... 320/105
6,144,185 A 11/2000 Dougherty et al. ..... 320/132
6,150,793 A 11/2000 Lesesky et al. ..... 320/104
6,158,000 A 12/2000 Collins ..... 713/1
6,161,640 A 12/2000 Yamaguchi ..... 180/65.8
6,163,156 A 12/2000 Bertness ..... 324/426
6,166,627 A 12/2000 Reeley ..... 340/426
6,167,349 A 12/2000 Alvarez ..... 702/63
6,172,483 B1 1/2001 Champlin ..... 320/134
6,172,505 B1 1/2001 Bertness ..... 324/430
6,181,545 B1 1/2001 Amatucci et al. ..... 361/502
6,211,651 B1 4/2001 Nemoto ..... 320/133
6,211,796 B1 4/2001 Toms et al. ..... 340/825.49
6,215,275 B1 4/2001 Bean ..... 320/106
6,222,342 B1 4/2001 Eggert et al. ..... 320/105
6,222,369 B1 4/2001 Champlin ..... 324/430
D442,503 S 5/2001 Lundbeck et al. ..... D10/77
6,225,808 B1 5/2001 Varghese et al. ..... 324/426
6,236,332 B1 5/2001 Conkright et al. ..... 340/825.06
6,238,253 B1 5/2001 Qualls ..... 439/759
6,242,887 B1 6/2001 Burke ..... 320/104
6,249,124 B1 6/2001 Bertness ..... 324/426
6,250,973 B1 6/2001 Lowery et al. ..... 439/763
6,254,438 B1 7/2001 Gaunt ..... 439/755
6,259,170 B1 7/2001 Limoge et al. ..... 307/10.8
6,259,254 B1 7/2001 Klang ..... 324/427
6,262,563 B1 7/2001 Champlin ..... 320/134
6,263,268 B1 7/2001 Nathanson ..... 701/29
6,265,974 B1 * 7/2001 D'Angelo et al. ..... 340/568.1

| | | | | |
|---|---|---|---|---|
| 6,275,008 | B1 | 8/2001 | Arai et al. | 320/132 |
| 6,285,868 | B1 | 9/2001 | LaDue | 455/410 |
| 6,294,896 | B1 | 9/2001 | Champlin | 320/134 |
| 6,294,897 | B1 | 9/2001 | Champlin | 320/153 |
| 6,304,087 | B1 | 10/2001 | Bertness | 324/426 |
| 6,307,349 | B1 | 10/2001 | Koenck et al. | 320/112 |
| 6,310,481 | B1 | 10/2001 | Bertess | 324/430 |
| 6,313,607 | B1 | 11/2001 | Champlin | 320/132 |
| 6,313,608 | B1 | 11/2001 | Varghese et al. | 32/132 |
| 6,316,914 | B1 | 11/2001 | Bertness | 320/134 |
| 6,323,650 | B1 | 11/2001 | Bertness et al. | 324/426 |
| 6,329,793 | B1 | 12/2001 | Bertness et al. | 320/132 |
| 6,331,762 | B1 | 12/2001 | Bertness | 320/134 |
| 6,332,113 | B1 | 12/2001 | Bertness | 702/63 |
| 6,346,795 | B1 | 2/2002 | Haraguchi et al. | 320/136 |
| 6,346,886 | B1 | 2/2002 | De La Huerga | 340/573.1 |
| 6,347,958 | B1 | 2/2002 | Tsai | 439/488 |
| 6,351,102 | B1 | 2/2002 | Troy | 320/139 |
| 6,356,042 | B1 | 3/2002 | Kahlon et al. | 318/138 |
| 6,359,441 | B1 | 3/2002 | Bertness | 324/426 |
| 6,359,442 | B1 | 3/2002 | Henningson et al. | 324/426 |
| 6,363,303 | B1 | 3/2002 | Bertness | 701/29 |
| RE37,677 | E | 4/2002 | Irie | 315/83 |
| 6,384,608 | B1 | 5/2002 | Namaky | 324/425 |
| 6,388,448 | B1 | 5/2002 | Cervas | 324/426 |
| 6,392,414 | B1 | 5/2002 | Bertness | 324/429 |
| 6,396,278 | B1 | 5/2002 | Makhija | 324/402 |
| 6,396,438 | B1 | 5/2002 | Seal | 342/127 |
| 6,411,098 | B1 | 6/2002 | Laletin | 324/436 |
| 6,417,669 | B1 | 7/2002 | Champlin | 324/426 |
| 6,424,157 | B1 | 7/2002 | Gollomp et al. | 324/430 |
| 6,424,158 | B1 | 7/2002 | Klang | 324/433 |
| 6,437,692 | B1 | 8/2002 | Petite et al. | 340/540 |
| 6,441,585 | B1 | 8/2002 | Bertness | 320/132 |
| 6,445,158 | B1 | 9/2002 | Bertness et al. | 320/104 |
| 6,449,726 | B1 | 9/2002 | Smith | 713/340 |
| 6,456,045 | B1 | 9/2002 | Troy et al. | 320/139 |
| 6,466,025 | B1 | 10/2002 | Klang | 324/429 |
| 6,466,026 | B1 | 10/2002 | Champlin | 324/430 |
| 6,495,990 | B1 | 12/2002 | Champlin | 320/132 |
| 6,504,480 | B1 | 1/2003 | Magnuson et al. | 340/571 |
| 6,526,361 | B1 | 2/2003 | Jones et al. | 702/63 |
| 6,529,141 | B1 | 3/2003 | Hanebeck et al. | 340/988 |
| 6,531,848 | B1 | 3/2003 | Chitsazan et al. | 320/153 |
| 6,534,993 | B1 | 3/2003 | Bertness | 324/433 |
| 6,542,076 | B1 | 4/2003 | Joao | 340/539 |
| 6,542,077 | B1 | 4/2003 | Joao | 340/539 |
| 6,542,080 | B1 * | 4/2003 | Page | 340/571 |
| 6,544,078 | B1 | 4/2003 | Palmisano et al. | 439/762 |
| 6,549,130 | B1 | 4/2003 | Joao | 340/539 |
| 6,556,019 | B1 | 4/2003 | Bertness | 324/426 |
| 6,556,819 | B1 | 4/2003 | Irvin | 455/410 |
| 6,566,883 | B1 | 5/2003 | Vonderhaar et al. | 324/426 |
| 6,570,385 | B1 | 5/2003 | Roberts et al. | 324/378 |
| 6,586,941 | B1 | 7/2003 | Bertness et al. | 324/426 |
| 6,587,046 | B1 | 7/2003 | Joao | 340/539.14 |
| 6,594,765 | B1 | 7/2003 | Sherman et al. | 713/202 |
| 6,597,150 | B1 | 7/2003 | Bertness et al. | 320/104 |
| 6,600,815 | B1 | 7/2003 | Walding | 379/93.07 |
| 6,607,136 | B1 | 8/2003 | Atsmon et al. | 235/492 |
| 6,609,656 | B1 | 8/2003 | Elledge | 235/382 |
| 6,614,349 | B1 * | 9/2003 | Proctor et al. | 340/572.1 |
| 6,614,350 | B1 | 9/2003 | Lunsford et al. | 340/572.1 |
| 6,618,644 | B1 | 9/2003 | Bean | 700/231 |
| 6,628,011 | B1 | 9/2003 | Droppo et al. | 307/43 |
| 6,629,054 | B1 | 9/2003 | Makhija et al. | 702/113 |
| 6,667,624 | B1 | 12/2003 | Raichle et al. | 324/522 |
| 6,679,212 | B1 | 1/2004 | Kelling | 123/179.28 |
| 6,777,945 | B1 | 8/2004 | Roberts et al. | 324/426 |
| 2002/0010558 | A1 | 1/2002 | Bertness et al. | 702/63 |
| 2002/0030495 | A1 | 3/2002 | Kechmire | 324/427 |
| 2002/0050163 | A1 | 5/2002 | Makhija et al. | 73/116 |
| 2002/0171428 | A1 | 11/2002 | Bertness | 324/426 |
| 2002/0176010 | A1 | 11/2002 | Wallach et al. | 348/229.1 |
| 2003/0025481 | A1 | 2/2003 | Bertness | 320/155 |
| 2003/0036909 | A1 | 2/2003 | Kato | 704/275 |
| 2003/0184262 | A1 | 10/2003 | Makhija | 320/130 |
| 2003/0184306 | A1 | 10/2003 | Bertness et al. | 324/426 |
| 2003/0194672 | A1 | 10/2003 | Roberts et al. | 431/196 |
| 2004/0000590 | A1 | 1/2004 | Raichle et al. | 235/462.01 |
| 2004/0000891 | A1 | 1/2004 | Raichle et al. | 320/107 |
| 2004/0000893 | A1 | 1/2004 | Raichle et al. | 320/135 |
| 2004/0000913 | A1 | 1/2004 | Raichle et al. | 324/426 |
| 2004/0000915 | A1 | 1/2004 | Raichle et al. | 324/522 |
| 2004/0002824 | A1 | 1/2004 | Raichle et al. | 702/63 |
| 2004/0002825 | A1 | 1/2004 | Raichle et al. | 702/63 |
| 2004/0002836 | A1 | 1/2004 | Raichle et al. | 702/188 |
| 2004/0049361 | A1 | 3/2004 | Hamdan et al. | 702/115 |
| 2004/0051533 | A1 | 3/2004 | Namaky | 324/426 |
| 2004/0054503 | A1 | 3/2004 | Namaky | 702/183 |

FOREIGN PATENT DOCUMENTS

| | | | |
|---|---|---|---|
| EP | 0 022 450 | A1 | 1/1981 |
| EP | 0 637 754 | A1 | 2/1995 |
| EP | 0 772 056 | A1 | 5/1997 |
| FR | 2 749 397 | | 12/1997 |
| GB | 2 088 159 | A | 6/1982 |
| GB | 2 246 916 | A | 10/1990 |
| GB | 2 387 235 | A | 10/2003 |
| JP | 59-17892 | | 1/1984 |
| JP | 59-17893 | | 1/1984 |
| JP | 59-17894 | | 1/1984 |
| JP | 59017894 | | 1/1984 |
| JP | 59215674 | | 12/1984 |
| JP | 60225078 | | 11/1985 |
| JP | 62-180284 | | 8/1987 |
| JP | 63027776 | | 2/1988 |
| JP | 03274479 | | 12/1991 |
| JP | 03282276 | | 12/1991 |
| JP | 4-8636 | | 1/1992 |
| JP | 04095788 | | 3/1992 |
| JP | 04131779 | | 5/1992 |
| JP | 04372536 | | 12/1992 |
| JP | 5216550 | | 8/1993 |
| JP | 7-128414 | | 5/1995 |
| JP | 09061505 | | 3/1997 |
| JP | 10056744 | | 2/1998 |
| JP | 10232273 | | 9/1998 |
| JP | 11103503 | A | 4/1999 |
| RU | 2089015 | C1 | 8/1997 |
| WO | WO 93/22666 | | 11/1993 |
| WO | WO 94/05069 | | 3/1994 |
| WO | WO 97/44652 | | 11/1997 |
| WO | WO 98/04910 | | 2/1998 |
| WO | WO 98/58270 | | 12/1998 |
| WO | WO 99/23738 | | 5/1999 |
| WO | WO 00/16083 | | 3/2000 |
| WO | WO 00/62049 | | 10/2000 |
| WO | WO 00/67359 | | 11/2000 |
| WO | WO 01/59443 | | 2/2001 |
| WO | WO 00/16614 | A1 | 3/2001 |
| WO | WO 00/16615 | A1 | 3/2001 |
| WO | WO 01/51947 | | 7/2001 |

OTHER PUBLICATIONS

"A review of impedance measurements for determination of the state-of-charge or state-of-health of secondary batteries", Journal of Power Sources, pp. 59-69, (1998).

"Improved Impedance Spectroscopy Technique For Status Determination of Production Li/$SO_2$ Batteries" Terrill Atwater et al., pp. 10-113, (1992).

"Search Report Under Section 17" for Great Britain Application No. GB0421447.4. (Jan. 28, 2005).

"Results of Discrete Frequency Immittance Spectroscopy (DFIS) Measurements of Lead Acid Batteries", by K.S. Champlin et al.,

*Proceedings of 23rd International Teleco Conference* (*INTELEC*), published Oct. 2001, IEE, pp. 433-440.
"Examination Report" from the U.K. Patent Office for U.K. App. No. 0417678.0.
"Notification of Transmittal of The International Search Report or the Declaration", PCT/US02/29461.
"Electrochemical Impedance Spectroscopy in Battery Development and Testing", *Batteries International,* Apr. 1997, pp. 59 and 62-63.
"Battery Impedance", by E. Willihnganz et al., *Electrical Engineering,* Sep. 1959, pp. 922-925.
"Determining The End of Battery Life", by S. DeBardelaben, *IEEE,* 1986, pp. 365-368.
"A Look at the Impedance of a Cell", by S. Debardelaben, *IEEE,* 1988, pp. 394-397.
"The Impedance of Electrical Storage Cells", by N.A. Hampson et al., *Journal of Applied Electrochemistry,* 1980, pp. 3-11.
"A Package for Impedance/Admittance Data Analysis", by B. Boukamp, *Solid State Ionics,* 1986, pp. 136-140.
"Precision of Impedance Spectroscopy Estimates of Bulk, Reaction Rate, and Diffusion Parameters", by J. Macdonald et al., *J. Electroanal, Chem.,* 1991, pp. 1-11.
Internal Resistance: Harbinger of Capacity Loss in Starved Electrolyte Sealed Lead Acid Batteries, by Vaccaro, F.J. et al., *AT&T Bell Laboratories,* 1987 IEEE, Ch. 2477, pp. 128,131.
IEEE Recommended Practice For Maintenance, Testings, and Replacement of Large Lead Storage Batteries for Generating Stations and Substations, *The Institute of Electrical and Electronics Engineers, Inc., ANSI/IEEE Std.* 450-1987, Mar. 9, 1987, pp. 7-15.
"Field and Laboratory Studies to Assess the State of Health of Valve-Regulated Lead Acid Batteries: Part I Conductance/Capacity Correlation Studies", by D. Feder et al., *IEEE,* Aug. 1992, pp. 218-233.
"JIS Japanese Industrial Standard-Lead Acid Batteries for Automobiles", *Japanese Standards Association UDC,* 621.355.2:629.113.006, Nov. 1995.
"Performance of Dry Cells", by C. Hambuechen, Preprint of *Am. Electrochem. Soc.,* Apr. 18-20, 1912, paper No. 19, pp. 1-5.
"A Bridge for Measuring Storage Battery Resistance", by E. Willihncanz, *The Electrochemical Society,* preprint 79-20, Apr. 1941, pp. 253-258.
National Semiconductor Corporation, "High Q Notch Filter", Linear Brief 5, Mar. 1969.
Burr-Brown Corporation, "Design A 60 Hz Notch Filter with the UAF42", Jan. 1994, AB-071.
National Semiconductor Corporation, "LMF90-4th-Order Elliptic Notch Filter", RRD-B30M115, Dec. 1994.
"Alligator Clips with Wire Penetrators", *J.S. Popper, Inc.* product information, downloaded from http://www.jspopper.com/, undated.
"#12: LM78S40 Simple Switcher DC to DC Converter", *ITM e-Catalog,* downloaded from http://www.pcbcafe.com, undated.
"Simple DC—DC Converts Allows Use of Single Battery", *Electronix Express,* downloaded from http://www.elexp.com/t_dc-dc.htm, undated.
"DC—DC Converter Basics", *Power Designers,* downloaded from http://www.powederdesigners.com/InfoWeb.design_center/articles/DC-DC/converter.shtm, undated.
"Notification of Transmittal of The International Search Report or the Declaration", PCT/US02/29461.
"Notification of Transmittal of The International Search Report or the Declaration", PCT/US03/07546.
"Notification of Transmittal of The International Search Report or the Declaration", PCT/US03/06577.
"Notification of Transmittal of The International Search Report or the Declaration", PCT/US03/07837.
"Notification of Transmittal of The International Search Report or the Declaration", PCT/US03/41561.
"Notification of Transmittal of The International Search Report or the Declaration", PCT/US03/27696.
Notification of Transmittal of the International Search Report along with the Search Report for International Application No. PCT/US03/27696, filed Sep. 4, 2003, date of mailing Apr. 15, 2004.
Operator's Manual for "Modular Computer Analyzer," SUN, Model MCA 3000, Table of Contents and pp. 1-1 to 1-2; 2-1 to 2-19; 3-1 to 3-47; 4-1 to 4-27; 5-1 to 5-18; 6-1 to 6-16; 7-1 to 7-9; 8-1 to 8-5; 9-1 to 9-13; 10-1 to 10-10; 11-1 to 11-22; 12-1 to 12-33; 13-1 to 13-2; 14-1 to 14-13 (1991).
Allen Test, Testproducts Division, "Programmed Training Course for 62-000 Series Smart Engine Analyzer," 2 page cover, Table of Contents, pp. 1-207 (1984).

* cited by examiner

THEFT PREVENTION DEVICE FOR AUTOMOTIVE VEHICLE SERVICE CENTERS

BACKGROUND OF THE INVENTION

The present invention relates to portable tools of the type used in automotive vehicle service centers. More specifically, the present invention relates to a theft prevention device used to prevent theft of portable tools from the automotive vehicle service centers.

Portable tools in automotive service centers have a variety of applications. Some portable tools can be used to test various components of an automobile such that problems associated with the automobile can be diagnosed. For example, storage batteries used in automotive vehicles, both electrical vehicles and vehicles with internal combustion engines, as well as power supplies such as backup power systems are often tested in an automotive service center. It is desirable to measure the condition of such storage batteries with a portable battery tester. For example, it can be useful to determine the amount of charge a storage battery can hold (i.e. the capacity of the battery) or the state of health of a storage battery.

A number of battery testing techniques are known in the art. These techniques include measuring the specific gravity of acid contained in a storage battery. Measuring a battery voltage and performing a load test on a battery in which a large load is placed on the battery and the response observed. More recently, a technique has been pioneered by Dr. Keith S. Champlin and Midtronics, Inc. of Willowbrook, Ill. for testing storage batteries by measuring the conductance of the batteries. This technique is described in a number of United State patents, for example, U.S. Pat. No. 3,873,911, issued Mar. 25, 1975, to Champlin, entitled ELECTRONIC BATTERY TESTING DEVICE; U.S. Pat. No. 3,909,708, issued Sep. 30, 1975, to Champlin, entitled ELECTRONIC BATTERY TESTING DEVICE; U.S. Pat. No. 4,816,768, issued Mar. 28, 1989, to Champlin, entitled ELECTRONIC BATTERY TESTING DEVICE; U.S. Pat. No. 4,825,170, issued Apr. 25, 1989, to Champlin, entitled ELECTRONIC BATTERY TESTING DEVICE WITH AUTOMATIC VOLTAGE SCALING; U.S. Pat. No. 4,881,038, issued Nov. 14, 1989, to Champlin, entitled ELECTRONIC BATTERY TESTING DEVICE WITH AUTOMATIC VOLTAGE SCALING TO DETERMINE DYNAMIC CONDUCTANCE; U.S. Pat. No. 4,912,416, issued Mar. 27, 1990, to Champlin, entitled ELECTRONIC BATTERY TESTING DEVICE WITH STATE-OF-CHARGE COMPENSATION; U.S. Pat. No. 5,140,269, issued Aug. 18, 1992, to Champlin, entitled ELECTRONIC TESTER FOR ASSESSING BATTERY/CELL CAPACITY; U.S. Pat. No. 5,343,380, issued Aug. 30, 1994, entitled METHOD AND APPARATUS FOR SUPPRESSING TIME VARYING SIGNALS IN BATTERIES UNDERGOING CHARGING OR DISCHARGING; U.S. Pat. No. 5,572,136, issued Nov. 5, 1996, entitled ELECTRONIC BATTERY TESTER WITH AUTOMATIC COMPENSATION FOR LOW STATE-OF-CHARGE; U.S. Pat. No. 5,574,355, issued Nov. 12, 1996, entitled METHOD AND APPARATUS FOR DETECTION AND CONTROL OF THERMAL RUNAWAY IN A BATTERY UNDER CHARGE; U.S. Pat. No. 5,585,416, issued Dec. 10, 1996, entitled APPARATUS AND METHOD FOR STEP-CHARGING BATTERIES TO OPTIMIZE CHARGE ACCEPTANCE; U.S. Pat. No. 5,585,728, issued Dec. 17, 1996, entitled ELECTRONIC BATTERY TESTER WITH AUTOMATIC COMPENSATION FOR LOW STATE-OF-CHARGE; U.S. Pat. No. 5,589,757, issued Dec. 31, 1996, entitled APPARATUS AND METHOD FOR STEP-CHARGING BATTERIES TO OPTIMIZE CHARGE ACCEPTANCE; U.S. Pat. No. 5,592,093, issued Jan. 7, 1997, entitled ELECTRONIC BATTERY TESTING DEVICE LOOSE TERMINAL CONNECTION DETECTION VIA A COMPARISON CIRCUIT; U.S. Pat. No. 5,598,098, issued Jan. 28, 1997, entitled ELECTRONIC BATTERY TESTER WITH VERY HIGH NOISE IMMUNITY; U.S. Pat. No. 5,656,920, issued Aug. 12, 1997, entitled METHOD FOR OPTIMIZING THE CHARGING LEAD-ACID BATTERIES AND AN INTERACTIVE CHARGER; U.S. Pat. No. 5,757,192, issued May 26, 1998, entitled METHOD AND APPARATUS FOR DETECTING A BAD CELL IN A STORAGE BATTERY; U.S. Pat. No. 5,821,756, issued Oct. 13, 1998, entitled ELECTRONIC BATTERY TESTER WITH TAILORED COMPENSATION FOR LOW STATE-OF-CHARGE; U.S. Pat. No. 5,831,435, issued Nov. 3, 1998, entitled BATTERY TESTER FOR JIS STANDARD; U.S. Pat. No. 5,914,605, issued Jun. 22, 1999, entitled ELECTRONIC BATTERY TESTER; U.S. Pat. No. 5,945,829, issued Aug. 31, 1999, entitled MIDPOINT BATTERY MONITORING; U.S. Pat. No. 6,002,238, issued Dec. 14, 1999, entitled METHOD AND APPARATUS FOR MEASURING COMPLEX IMPEDANCE OF CELLS AND BATTERIES; U.S. Pat. No. 6,037,751, issued Mar. 14, 2000, entitled APPARATUS FOR CHARGING BATTERIES; U.S. Pat. No. 6,037,777, issued Mar. 14, 2000, entitled METHOD AND APPARATUS FOR DETERMINING BATTERY PROPERTIES FROM COMPLEX IMPEDANCE/ADMITTANCE; U.S. Pat. No. 6,051,976, issued Apr. 18, 2000, entitled METHOD AND APPARATUS FOR AUDITING A BATTERY TEST; U.S. Pat. No. 6,081,098, issued Jun. 27, 2000, entitled METHOD AND APPARATUS FOR CHARGING A BATTERY; U.S. Pat. No. 6,091,245, issued Jul. 18, 2000, entitled METHOD AND APPARATUS FOR AUDITING A BATTERY TEST; U.S. Pat. No. 6,104,167, issued Aug. 15, 2000, entitled METHOD AND APPARATUS FOR CHARGING A BATTERY; U.S. Pat. No. 6,137,269, issued Oct. 24, 2000, entitled METHOD AND APPARATUS FOR ELECTRONICALLY EVALUATING THE INTERNAL TEMPERATURE OF AN ELECTROCHEMICAL CELL OR BATTERY; U.S. Pat. No. 6,163,156, issued Dec. 19, 2000, entitled ELECTRICAL CONNECTION FOR ELECTRONIC BATTERY TESTER; U.S. Pat. No. 6,172,483, issued Jan. 9, 2001, entitled METHOD AND APPARATUS FOR MEASURING COMPLEX IMPEDANCE OF CELL AND BATTERIES; U.S. Pat. No. 6,172,505, issued Jan. 9, 2001, entitled ELECTRONIC BATTERY TESTER; U.S. Pat. No. 6,222,369, issued Apr. 24, 2001, entitled METHOD AND APPARATUS FOR DETERMINING BATTERY PROPERTIES FROM COMPLEX IMPEDANCE/ADMITTANCE; U.S. Pat. No. 6,225,808, issued May 1, 2001, entitled TEST COUNTER FOR ELECTRONIC BATTERY TESTER; U.S. Pat. No. 6,249,124, issued Jun. 19, 2001, entitled ELECTRONIC BATTERY TESTER WITH INTERNAL BATTERY; U.S. Pat. No. 6,259,254, issued Jul. 10, 2001, entitled APPARATUS AND METHOD FOR CARRYING OUT DIAGNOSTIC TESTS ON BATTERIES AND FOR RAPIDLY CHARGING BATTERIES; U.S. Pat. No. 6,262,563, issued Jul. 17, 2001, entitled METHOD AND APPARATUS FOR MEASURING COMPLEX ADMITTANCE OF CELLS AND BATTERIES; U.S. Pat. No. 6,294,896, issued Sep. 25, 2001; entitled METHOD AND APPARATUS FOR MEASURING COMPLEX SELF-IMMITANCE OF A GENERAL ELECTRICAL ELEMENT; U.S. Pat. No. 6,294,897, issued Sep. 25, 2001, entitled METHOD AND APPARATUS FOR ELECTRONICALLY EVALUATING THE INTERNAL TEMPERATURE OF AN ELECTROCHEMICAL CELL OR BATTERY; U.S. Pat. No. 6,304,087, issued Oct. 16, 2001, entitled APPARATUS FOR CALIBRATING ELECTRONIC BATTERY TESTER; U.S. Pat. No. 6,310,481, issued Oct. 30, 2001, entitled ELECTRONIC BATTERY TESTER; U.S. Pat. No. 6,313,607, issued Nov. 6, 2001, entitled METHOD AND APPARATUS FOR EVALUATING STORED CHARGE IN AN ELECTROCHEMICAL CELL OR BATTERY; U.S. Pat. No. 6,313,608, issued Nov. 6, 2001, entitled METHOD AND APPARATUS FOR CHARGING A BATTERY; U.S. Pat. No. 6,316,914, issued Nov. 13, 2001, entitled TESTING PARALLEL STRINGS OF STORAGE BATTERIES; U.S. Pat. No. 6,323,650, issued Nov. 27, 2001, entitled ELECTRONIC BATTERY TESTER; U.S. Pat. No. 6,329,793, issued Dec. 11, 2001, entitled METHOD AND APPARATUS FOR CHARGING A BATTERY; U.S. Pat. No. 6,331,762, issued Dec. 18, 2001, entitled ENERGY MANAGEMENT SYSTEM FOR AUTOMOTIVE VEHICLE; U.S. Pat. No. 6,332,113, issued Dec. 18, 2001, entitled ELECTRONIC BATTERY TESTER; U.S. Pat. No. 6,351,102, issued Feb. 26, 2002, entitled AUTOMOTIVE BATTERY CHARGING SYSTEM TESTER; U.S. Pat. No. 6,359,441, issued Mar. 19, 2002, entitled ELECTRONIC BATTERY TESTER; U.S. Pat. No. 6,363,303, issued Mar. 26, 2002, entitled ALTERNATOR DIAGNOSTIC SYSTEM, U.S. Pat. No. 6,392,414, issued May 21, 2002, entitled ELECTRONIC BATTERY TESTER; U.S. Pat. No. 6,417,669, issued Jul. 9, 2002, entitled SUPPRESSING INTERFERENCE IN AC MEASUREMENTS OF CELLS, BATTERIES AND OTHER ELECTRICAL ELEMENTS; U.S. Pat. No. 6,424,158, issued Jul. 23, 2002, entitled APPARATUS AND METHOD FOR CARRYING OUT DIAGNOSTIC TESTS ON BATTERIES AND FOR RAPIDLY CHARGING BATTERIES; U.S. Pat. No. 6,441,585, issued Aug. 17, 2002, entitled APPARATUS AND METHOD FOR TESTING RECHARGEABLE ENERGY STORAGE BATTERIES; U.S. Pat. No. 6,445,158, issued Sep. 3, 2002, entitled VEHICLE ELECTRICAL SYSTEM TESTER WITH ENCODED OUTPUT; U.S. Pat. No. 6,456,045, issued Sep. 24, 2002, entitled INTEGRATED CONDUCTANCE AND LOAD TEST BASED ELECTRONIC BATTERY TESTER; U.S. Pat. No. 6,466,025, issued Oct. 15, 2002, entitled ALTERNATOR TESTER; U.S. Pat. No. 6,466,026, issued Oct. 15, 2002, entitled PROGRAMMABLE CURRENT EXCITER FOR MEASURING AC IMMITTANCE OF CELLS AND BATTERIES; U.S. Pat. No. 6,534,993, issued Mar. 18, 2003, entitled ELECTRONIC BATTERY TESTER; U.S. Pat. No. 6,544,078, issued Apr. 8, 2003, entitled BATTERY CLAMP WITH INTEGRATED CURRENT SENSOR; U.S. Pat. No. 6,556,019, issued Apr. 29, 2003, entitled ELECTRONIC BATTERY TESTER; U.S. Pat. No. 6,566,883, issued May 20, 2003, entitled ELECTRONIC BATTERY TESTER; U.S. Pat. No. 6,586,941, issued Jul. 1, 2003, entitled BATTERY TESTER WITH DATABUS; U.S. Pat. No. 6,597,150, issued Jul. 22, 2003, entitled METHOD OF DISTRIBUTING JUMP-START BOOSTER PACKS; U.S. Ser. No. 09/780,146, filed Feb. 9, 2001, entitled STORAGE BATTERY WITH INTEGRAL BATTERY TESTER; U.S. Ser. No. 09/756,638, filed Jan. 8, 2001, entitled METHOD AND APPARATUS FOR DETERMINING BATTERY PROPERTIES FROM COMPLEX IMPEDANCE/ADMITTANCE; U.S. Ser. No. 09/862,783, filed May 21, 2001, entitled METHOD AND APPARATUS FOR TESTING CELLS AND BATTERIES EMBEDDED IN SERIES/PARALLEL SYSTEMS; U.S. Ser. No. 09/960,117, filed Sep. 20, 2001, entitled IN-VEHICLE BATTERY MONITOR; U.S. Ser. No. 09/908,278, filed Jul. 18, 2001, entitled BATTERY CLAMP WITH EMBEDDED ENVIRONMENT SENSOR; U.S. Ser. No. 09/880,473, filed Jun. 13, 2001; entitled BATTERY TEST MODULE; U.S. Ser. No. 09/940,684, filed Aug. 27, 2001, entitled METHOD AND APPARATUS FOR EVALUATING STORED CHARGE IN AN ELECTROCHEMICAL CELL OR BATTERY; U.S. Ser. No. 60/330,441, filed Oct. 17, 2001, entitled ELECTRONIC BATTERY TESTER WITH RELATIVE TEST OUTPUT; U.S. Ser. No. 60/348,479, filed Oct. 29, 2001, entitled CONCEPT FOR TESTING HIGH POWER VRLA BATTERIES; U.S. Ser. No. 10/046,659, filed Oct. 29, 2001, entitled ENERGY MANAGEMENT SYSTEM FOR AUTOMOTIVE VEHICLE; U.S. Ser. No. 09/993,468, filed Nov. 14, 2001, entitled KELVIN CONNECTOR FOR A BATTERY POST; U.S. Ser. No. 09/992,350, filed Nov. 26, 2001, entitled ELECTRONIC BATTERY TESTER, U.S. Ser. No. 60/341,902, filed Dec. 19, 2001, entitled BATTERY TESTER MODULE; U.S. Ser. No. 10/042,451, filed Jan. 8, 2002, entitled BATTERY CHARGE CONTROL DEVICE, U.S. Ser. No. 10/073,378, filed Feb. 8, 2002, entitled METHOD AND APPARATUS USING A CIRCUIT MODEL TO EVALUATE CELL/BATTERY PARAMETERS; U.S. Ser. No. 10/093,853, filed Mar. 7, 2002, entitled ELECTRONIC BATTERY TESTER WITH NETWORK COMMUNICATION; U.S. Ser. No. 60/364,656, filed Mar. 14, 2002, entitled ELECTRONIC BATTERY TESTER WITH LOW TEMPERATURE RATING DETERMINATION; U.S. Ser. No. 10/098,741, filed Mar. 14, 2002, entitled METHOD AND APPARATUS FOR AUDITING A BATTERY TEST; U.S. Ser. No. 10/112,114, filed Mar. 28, 2002; U.S. Ser. No. 10/109,734, filed Mar. 28, 2002; U.S. Ser. No. 10/112,105, filed Mar. 28, 2002, entitled CHARGE CONTROL SYSTEM FOR A VEHICLE BATTERY; U.S. Ser. No. 10/112,998, filed Mar. 29, 2002, entitled BATTERY TESTER WITH BATTERY REPLACEMENT OUTPUT; U.S. Ser. No. 10/119,297, filed Apr. 9, 2002, entitled METHOD AND APPARATUS FOR TESTING CELLS AND BATTERIES EMBEDDED IN SERIES/PARALLEL SYSTEMS; U.S. Ser. No. 60/379,281, filed May 8, 2002, entitled METHOD FOR DETERMINING BATTERY STATE OF CHARGE; U.S. Ser. No. 60/387,046, filed Jun. 7, 2002, entitled METHOD AND APPARATUS FOR INCREASING THE LIFE OF A STORAGE BATTERY; U.S. Ser. No. 10/177,635, filed Jun. 21, 2002, entitled BATTERY CHARGER WITH BOOSTER PACK; U.S. Ser. No. 10/207,495, filed Jul. 29, 2002, entitled KELVIN CLAMP FOR ELECTRICALLY COUPLING TO A BATTERY CONTACT; U.S. Ser. No. 10/200,041, filed Jul. 19, 2002, entitled AUTOMOTIVE VEHICLE ELECTRICAL SYSTEM DIAGNOSTIC DEVICE; U.S. Ser. No. 10/217,913, filed Aug. 13, 2002, entitled, BATTERY TEST MODULE; U.S. Ser. No. 60/408,542, filed Sep. 5, 2002, entitled BATTERY TEST OUTPUTS ADJUSTED BASED UPON TEMPERATURE; U.S. Ser. No. 10/246,439, filed Sep. 18, 2002, entitled BATTERY TESTER UPGRADE USING SOFTWARE KEY; U.S. Ser. No. 60/415,399, filed Oct. 2, 2002, entitled QUERY BASED ELECTRONIC BATTERY TESTER; and U.S. Ser. No. 10/263,473, filed Oct. 2, 2002, entitled ELECTRONIC BATTERY TESTER WITH RELATIVE TEST OUTPUT; U.S. Ser. No. 60/415,796, filed Oct. 3, 2002, entitled QUERY BASED ELECTRONIC BATTERY TESTER; U.S. Ser. No. 10/271,342, filed Oct. 15, 2002, entitled IN-VEHICLE BATTERY MONITOR; U.S. Ser. No. 10/270,777, filed Oct. 15, 2002, entitled PROGRAMMABLE CURRENT EXCITER FOR MEASURING AC IMMITTANCE OF CELLS AND BATTERIES; U.S. Ser. No. 10/310,515, filed Dec. 5, 2002, entitled BATTERY TEST MODULE; U.S. Ser. No. 10/310,490, filed Dec. 5, 2002, entitled ELECTRONIC BATTERY TESTER; U.S. Ser. No. 10/310,385, filed Dec. 5, 2002, entitled BATTERY TEST MODULE, U.S. Ser. No. 60/437,255, filed Dec. 31, 2002, entitled REMAINING TIME PREDICTIONS, U.S. Ser. No. 60/437,224, filed Dec. 31, 2002, entitled DISCHARGE VOLTAGE PREDICTIONS, U.S. Ser. No. 10/349,053, filed Jan. 22, 2003, entitled APPARATUS AND METHOD FOR PROTECTING A BATTERY FROM OVERDISCHARGE, U.S. Ser. No. 10/388,855, filed Mar. 14, 2003, entitled ELECTRONIC BATTERY TESTER WITH BATTERY FAILURE TEMPERATURE DETERMINATION, U.S. Ser. No. 10/396,550, filed Mar. 25, 2003, entitled ELECTRONIC BATTERY TESTER, U.S. Ser. No. 60/467,872, filed May 5, 2003, entitled METHOD FOR DETERMINING BATTERY STATE OF CHARGE, U.S. Ser. No. 60/477,082, filed Jun. 9, 2003, entitled ALTERNATOR TESTER, U.S. Ser. No. 10/460,749, filed Jun. 12, 2003, entitled MODULAR BATTERY TESTER FOR SCAN TOOL, U.S. Ser. No. 10/462,323, filed Jun. 16, 2003, entitled ELECTRONIC BATTERY TESTER HAVING A USER INTERFACE TO CONFIGURE A PRINTER, U.S. Ser. No. 10/601,608, filed Jun. 23, 2003, entitled CABLE FOR ELECTRONIC BATTERY TESTER, U.S. Ser. No. 10/601,432, filed Jun. 23, 2003, entitled BATTERY TESTER CABLE WITH MEMORY; U.S. Ser. No. 60/490,153, filed Jul. 25, 2003, entitled SHUNT CONNECTION TO A PCB FOR AN ENERGY MANAGEMENT SYSTEM EMPLOYED IN AN AUTOMOTIVE VEHICLE, U.S. Ser. No. 10/653,342, filed Sep. 2, 2003, entitled ELECTRONIC BATTERY TESTER CONFIGURED TO PREDICT A LOAD TEST RESULT, U.S. Ser. No. 10/654,098, filed Sep. 3, 2003, entitled BATTERY TEST OUTPUTS ADJUSTED BASED UPON BATTERY TEMPERATURE AND THE STATE OF DISCHARGE OF THE BATTERY, U.S. Ser. No. 10/656,526, filed Sep. 5, 2003, entitled METHOD AND APPARATUS FOR MEASURING A PARAMETER OF A VEHICLE ELECTRICAL SYSTEM, U.S. Ser. No. 10/656,538, filed Sep. 5, 2003, entitled ALTERNATOR TESTER WITH ENCODED OUTPUT, which are incorporated herein in their entirety.

The theft of portable devices, especially portable electronic devices, continues to be a widespread problem. Portable tools used by technicians in automotive vehicle service centers are generally mobile as well as expensive. The service center environment is often chaotic and includes a large quantity of people arriving and departing. Portable tools can easily be stolen without notice of those managing or working at the center.

SUMMARY OF THE INVENTION

An apparatus and method for preventing theft in automotive vehicle service centers includes a transmitter configured to transmit a wireless security signal which defines a perimeter. At least one portable tool having a receiver configured to receive the transmitted security signal. Security circuitry is actuated if the tool is outside and/or near the perimeter defined by the security signal.

BRIEF DESCRIPTION OF THE DRAWINGS

FIG. 1-2 is a simplified block diagram of the theft prevention device of FIG. 1-1 after the theft has occurred in accordance with an embodiment of the present invention.

FIG. 2-1 is a simplified block diagram of a theft prevention device prior to a theft in accordance with an embodiment of the present invention.

FIG. 2-2 is a simplified block diagram of the theft prevention device of FIG. 2-1 after the theft has occurred in accordance with an embodiment of the present invention.

DETAILED DESCRIPTION OF THE PREFERRED EMBODIMENTS

Figure 1:
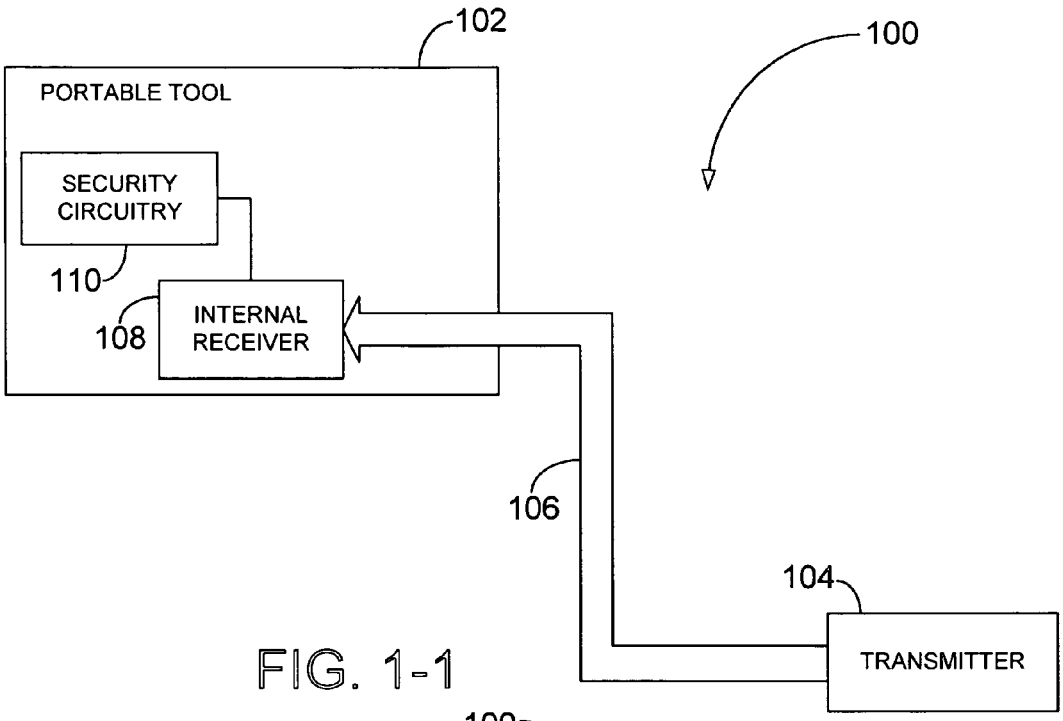
FIG. 1-1 is a simplified block diagram of a theft prevention device prior to a theft in accordance with an embodiment of the present invention.

FIG. 1-1 is a simplified block diagram of theft prevention device 100 prior to a theft in accordance with an embodiment of the present invention. Device 100 includes transmitter 104 configured to transmit a wireless security signal 106 that defines a perimeter. Device 100 also includes a receiver 108 embedded in portable tool 102 and operably coupled to security circuitry 110. Security signal 106 can be encoded with a key such that secure communication can take place between transmitter 104 and portable tool 102. The key can be randomly changeable to ensure secure communication. Security signal 106 can also transmit other information besides defining a perimeter. Examples of other information include software updates for the portable tool, messages for the operator and time updates.

Receiver 108 is configured to receive the transmitted security signal 106. If portable tool 102 remains located within the perimeter defined by the wireless security signal, then proper use and/or storage of portable tool 102 is being practiced within an automotive vehicle service center. If, however, portable tool 102 is carried outside the perimeter, a theft has occurred. For example, non-receipt of security signal 106 by receiver 108 can indicate that portable tool 102 is outside of the perimeter. In another example, receipt of security signal 106 having a signal strength less than a predetermined minimum signal strength can indicate that portable tool 102 is outside the perimeter. In FIG. 1-1, transmitter 104 is in communication with receiver 108 and the strength of security signal 106 is greater than the predetermined minimum signal strength. Therefore, portable tool 102 is located within the perimeter defined by security signal 106 and is in proper use.

Figures 1, 2:
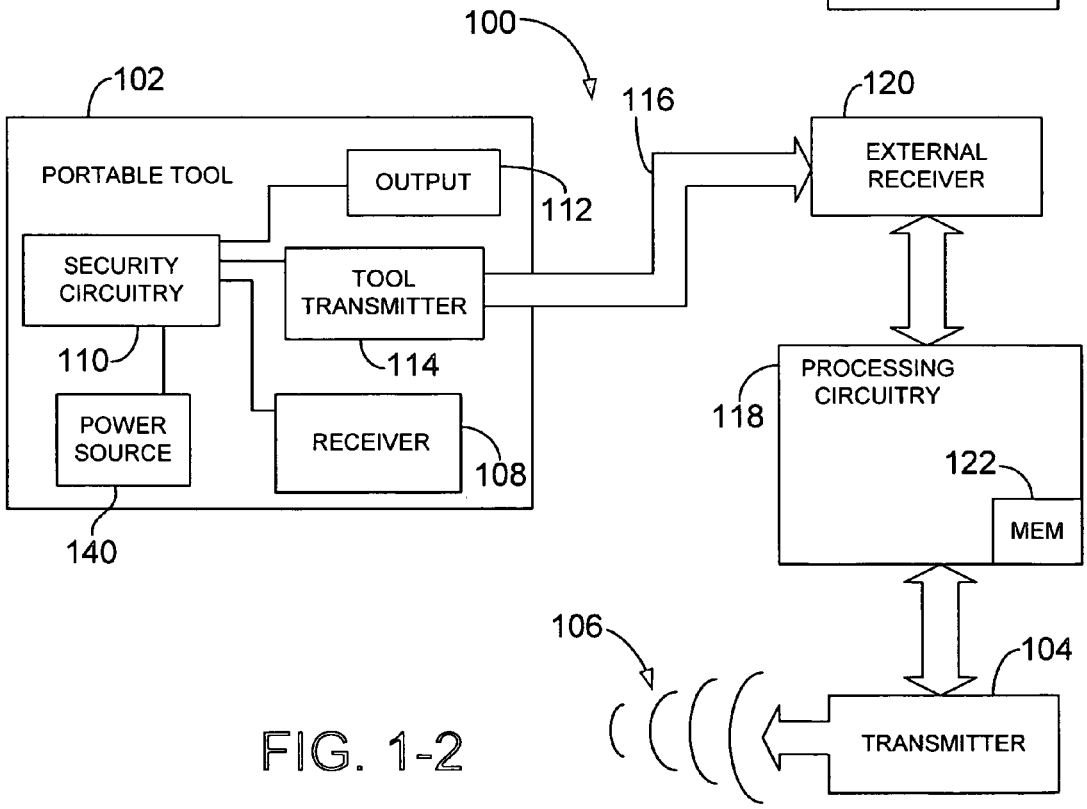
Figures 1, 2:
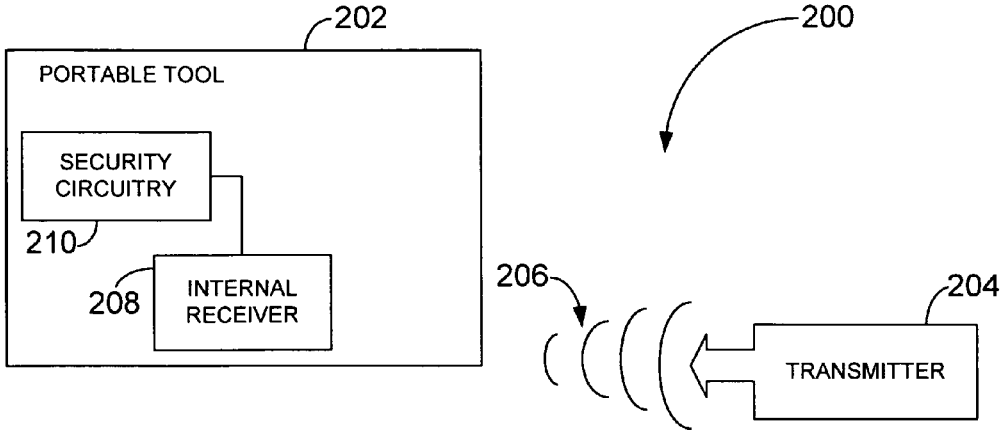
Figure 2:
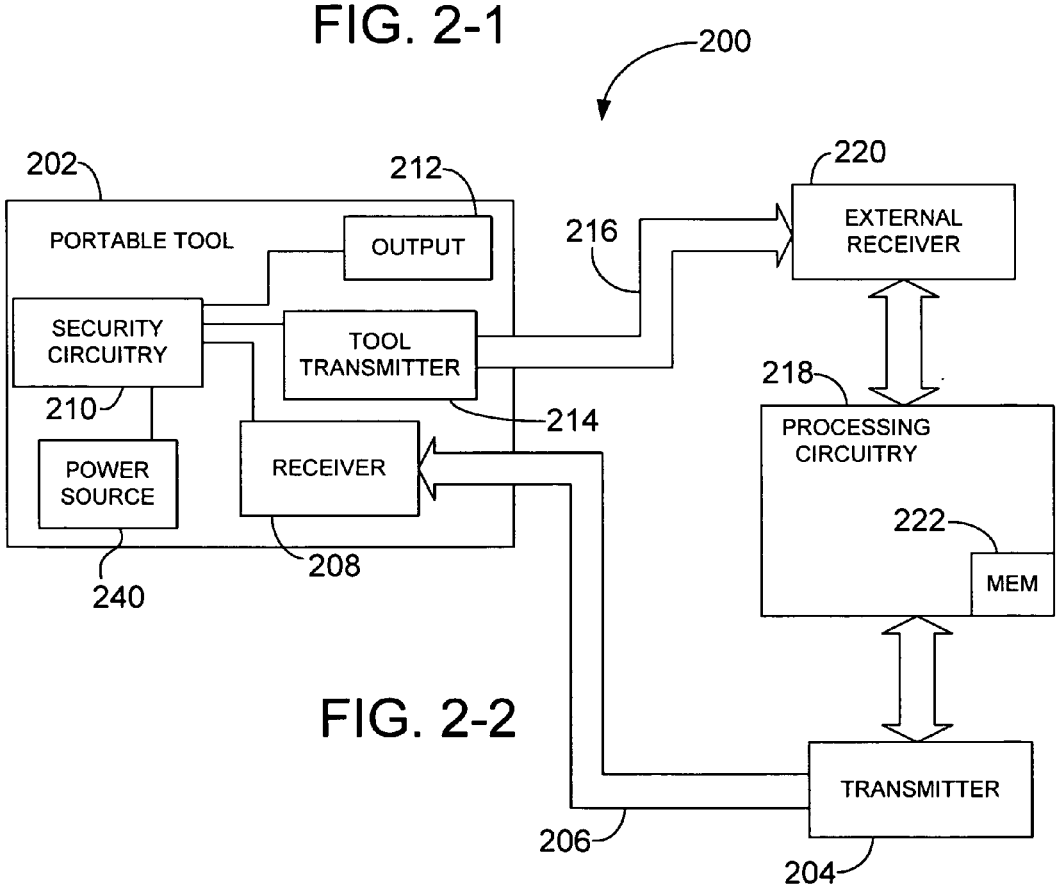

FIG. 1-2 is a simplified block diagram of theft prevention device 100 of FIG. 1-1 after the theft has occurred in accordance with an embodiment of the present invention. Portable tool 102 includes an output 112 operably coupled to security circuitry 110 and tool transmitter 114 operably coupled to security circuitry 110. Portable tool 102 also includes an internal power source 140 configured to supply power to security circuitry 110 such that portable tool can receive security signal 106, output the continuous audible noise and transmit theft signal 116. As illustrated in FIG. 1-2, transmitter 104 has either lost communication with receiver 108 or security signal 106 is less than the predetermined minimum signal strength. Therefore, a theft has occurred because portable tool 102 has been carried outside of the perimeter defined by security signal 106.

When a theft occurs, security circuitry 110 is configured to disable portable tool 102 causing the tool to become inoperable. For example, security circuitry 110 can disable portable tool 102 after the portable tool has been outside of the perimeter for a predetermined period of time. Waiting the predetermined period of time prevents portable tool 102 from disabling if there was a temporary interruption in security signal 106. In addition, security circuitry 110 instructs output 112 to emit a continuous audible noise. This continuous audible noise will alert service center employees that portable tool 102 has been stolen and alert others outside of the service center. Furthermore, when portable tool 102 is carried outside of the perimeter defined by security signal 106, security circuitry 110 instructs tool transmitter 114 to transmit theft signal 116. It should be noted that portable tool 102 can also be reset and/or overridden with a hardware or software key such that theft protection device 100 is disabled.

As illustrated in FIG. 1-2, device 100 further includes processing circuitry 118 operably coupled to transmitter 104 and external receiver 120 operably coupled to processing circuitry 118. External receiver 120 is configured to receive the transmitted theft signal 116. When external receiver 120 receives the transmitted theft signal 116, processing circuitry 118 is configured to output an audible alarm. In addition, processing circuitry 118 records in memory 122 information related to theft signal 116 for later user retrieval. For example, processing circuitry 118 can record a date and time when portable tool 102 was stolen. Processing circuitry 118 can also record a serial number or identification number related to the particular portable tool 102 stolen based on the received theft signal 116.

Both security signal 104 and theft signal 116 can include a variety of signals. For example, transmitter 104 and tool transmitter 114 can transmit a diffused infrared signal while receiver 108 and external receiver 120 can be configured to receive a diffused infrared signal. Diffused infrared signals utilize the walls and ceilings of a room to bounce infrared signals between a transmitter and a receiver. Thus, people walking about the room as well as fixed obstructions will not interfere with sustained infrared communications. However, transmitter 104, external receiver 120 and portable tool 102 must all be located in the same room because infrared communication can not penetrate obstructions, such as walls. In another example, transmitter 104 and tool transmitter 114 can transmit a radio frequency (RF) signal while receiver 108 and external receiver 120 can be configured to receive a RF signal. In this example, transmitter 104, external receiver 120 and portable tool 102 can all be located in different rooms because RF signals can easily penetrate walls and other obstructions. Two common standards for RF communication include the Bluetooth protocol and the 802.11(b) protocol. The Bluetooth protocol is cost-effective and easy to implement. However, the distance the Bluetooth signal covers is less than the distance covered by the 802.11(b) signal.

FIG. 2-1 is a simplified block diagram of theft prevention device 200 prior to a theft in accordance with an embodiment of the present invention. Device 200 includes transmitter 204 configured to transmit a wireless security signal 206 that defines a perimeter. Device 200 also includes a receiver 208 embedded in portable tool 202 and operably coupled to security circuitry 210. Security signal 206 can be encoded with a key such that secure communication can take place between transmitter 204 and portable tool 202. The key can be randomly changeable to ensure secure communication. Security signal 206 can also transmit other information besides defining a perimeter. Examples of other information include software updates for the portable tool, messages for the operator and time updates.

Receiver 208 is configured to receive the transmitted security signal 206. If portable tool 202 remains located outside the perimeter, then proper use and/or storage of portable tool 202 is being practiced within the automotive service center. If, however, portable tool 202 at least passes through the perimeter, a theft has occurred. For example, receipt of security signal 106 can indicate that portable tool 202 is within the perimeter defined by the security signal. In another example, receipt of security signal 106 having a signal strength greater than a predetermined minimum signal strength can indicate that portable tool 202 is located within the perimeter. In FIG. 2-1, transmitter 204 is not in communication with receiver 208 or security signal 206 has a signal strength less than the predetermined minimum signal strength. Therefore, portable tool 102 is located outside the perimeter defined by security signal 206 and is in proper use.

FIG. 2-2 is a simplified block diagram of theft prevention device 200 of FIG. 2-1 after a theft has occurred in accordance with an embodiment of the present invention. Portable tool 202 includes an output 212 operably coupled to security circuitry 210 as well as tool transmitter 214 operably coupled to security circuitry 210. Portable tool 202 also includes an internal power source 240 configured to supply power to security circuitry 210 such that portable tool can receive security signal 206, output the continuous audible noise and transmit theft signal 216. As illustrated in FIG. 2-2, transmitter 204 is in communication with receiver 208 or security signal 206 has a signal strength greater than the predetermined minimum signal strength. Therefore, portable tool 202 has at least partially passed through the perimeter defined by security signal 206 and a theft has occurred.

If a theft has occurred, security circuitry 210 is configured to disable portable tool 202 causing the tool to become inoperable. For example, security circuitry 110 can disable portable tool 102 after the portable tool has been outside of the perimeter for a predetermined period of time. Waiting the predetermined period of time prevents portable tool 102 from disabling if there was a temporary interruption in security signal 106. In addition, security circuitry 210 instructs output 212 to emit a continuous audible noise. This continuous audible noise will alert service center employees that portable tool 202 has been stolen and alert others outside of the service center. Furthermore, when portable tool 202 at least partially passes through the perimeter defined by security signal 206, security circuitry 210 instructs tool transmitter 214 to transmit theft signal 216. It should be noted that portable tool 202 can also be reset and/or overridden with a hardware or software key such that theft protection device 200 is disabled.

As illustrated in FIG. 2-2, device 200 further includes processing circuitry 218 operably coupled to transmitter 204 and external receiver 220 operably coupled to processing circuitry 218. External receiver 220 is configured to receive the transmitted theft signal 216. If external receiver 220 receives the transmitted theft signal 216, then processing circuitry 218 is configured to output an audible alarm. In addition, processing circuitry 218 records in memory 222 information related to theft signal 216 for later user retrieval.

For example, processing circuitry 218 can record a date and time when portable tool 202 was stolen. In addition, theft signal 216 can include information related to identification of the particular portable tool 202 based on theft signal 216. Thus, processing circuitry 218 can also record a serial number or identification number related to the particular portable tool 202 stolen.

Both security signal 204 and theft signal 216 can include a variety of signals. For example, transmitter 204 and tool transmitter 214 can transmit a diffused infrared signal while receiver 208 and external receiver 220 can be configured to receive a diffused infrared signal. In another example, transmitter 204 can transmit a direct infrared signal (or beam of infrared light) and receiver 208 can be configured to receive the direct infrared signal. In another example, transmitter 204 and tool transmitter 214 can transmit a radio frequency (RF) signal while receiver 208 and external receiver 220 can be configured to receive a RF signal. Two common standards for RF communication include the Bluetooth protocol and the 802.11(b) protocol. In yet another example, receiver 208, tool transmitter 214 and security circuitry 210 can include a radio frequency identification (RFID) tag, while external receiver 220 and transmitter 204 can include a RFID reader. In this example, the RFID tag at least partially passes through the perimeter defined by security signal 206. The RFID tag detects security signal 206 and disables portable tool 202 from operation as well as instructs output 212 to emit a continuous audible noise as described above. After the RFID reader transmits RF signals to activate the tag, the RFID reader decodes the data encoded in the tag's security circuitry. The decoded data is passed to processing circuitry 218 for identification and reporting as well as causes processing circuitry to sound an audible alarm as discussed above.

Figure 3:
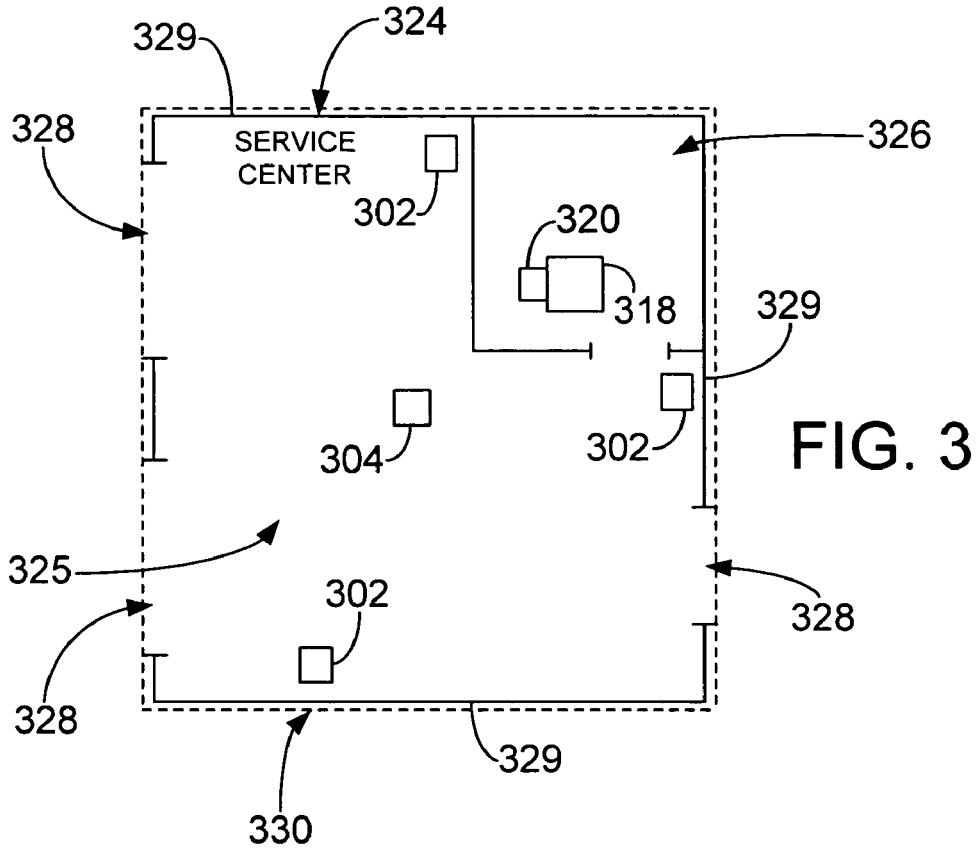
FIG. 3 is a simplified block diagram of an automotive vehicle service center in accordance with an embodiment of the present invention.

FIG. 3 is a simplified block diagram of automotive service center 324. Automotive service center 324 includes repair area 325 as well as inner office space 326. Service center 324 also includes a plurality of exits and entrances 328 around outer walls 329 of center 324. As illustrated in FIG. 3, transmitter 304 is located in repair area 325 and is transmitting a security signal (FIGS. 1-1 and 1-2). The security signal defines a perimeter represented by dashed line 330. A plurality of portable tools 302 are located about repair area 325. Each portable tool 302 receives the security signal with an receiver (FIGS. 1-1 and 1-2). If a person were to pick up at least one of the plurality of tools 302 and carry tool 302 outside of dashed line 330, then the security circuitry (FIGS. 1-1 and 1-2) of that particular portable tool 302 would disable the tool. Therefore, portable tool 302 is rendered inoperable. In addition, the security circuitry instructs an output (FIGS. 1-1 and 1-2) to emit a continuous audible noise.

Furthermore, when a person carries at least one portable tool 302 outside of the dashed line, the security circuitry instructs a tool transmitter (FIGS. 1-1 and 1-2) embedded within portable tool 302 to transmit a theft signal (FIGS. 1-1 and 1-2). An external receiver 320 located within inner office space 326 and operably coupled to processing circuitry 318 is configured to receive the transmitted theft signal. Upon receipt of the theft signal by external receiver 320, processing circuitry 318 records information related to the theft signal as well as outputs an audible alarm. In accordance with FIG. 3, the security signal can be a diffused infrared signal or a RF signal. The theft signal can be a RF signal but not an infrared signal since infrared signal can not penetrate the walls of inner office space 326. Those skilled in the art will recognize that the theft signal could be a diffused infrared signal if the external receiver was located in repair area 325. Communication between external receiver 320 and processing circuitry 318 and between the transmitter 304 and processing circuitry can be any type of cable connection as well as any type of wireless connection.

Figure 4:
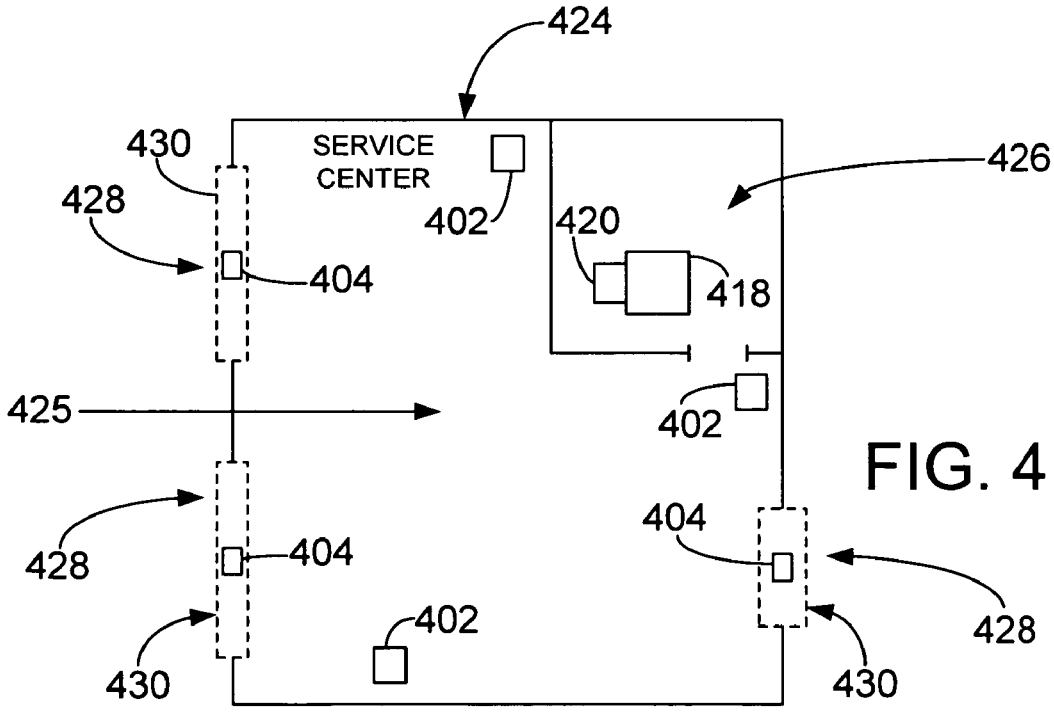
FIG. 4 is a simplified block diagram of an automotive vehicle service center in accordance with an embodiment of the present invention.

FIG. 4 is a simplified block diagram of automotive service center 424. Automotive service center 424 includes repair area 425 as well as inner office space 426. Service center 424 also includes a plurality of exits and entrances 428 around the outer walls 429 of center 424. FIG. 4 also illustrates a plurality of transmitters 404. Each transmitter 404 is located within each exit and entrance 428. Each transmitter 404 is configured to transmit a security signal (FIGS. 2-1 and 2-2). Each security signal defines a perimeter represented by dashed lines 430. A plurality of portable tools 402 are located about repair area 425. Each portable tool 402 is configured to receive the security signal with a receiver (FIGS. 2-1 and 2-2). If a person were to pick up at least one of the plurality of tools 402 and carry it through an entrance or exit 428, then tool 402 would at least pass partially through one of the perimeters illustrated by dashed line 430. Upon passing at least partially through one perimeter, the security circuitry (FIGS. 2-1 and 2-2) of that particular portable tool 402 would disable the tool. Therefore, portable tool 402 is rendered inoperable. In addition, the security circuitry instructs an output (FIGS. 2-1 and 2-2) to emit a continuous audible noise.

Furthermore, if a person carries at least one portable tool 402 at least partially through an entrance or exit 428, the security circuitry instructs a tool transmitter (FIGS. 2-1 and 2-2) embedded within portable tool 402 to transmit a theft signal (FIGS. 2-1 and 2-2). An external receiver 420 located within inner office space 426 and operably coupled to processing circuitry 418 is configured to receive the transmitted theft signal. Upon receipt of the theft signal by external receiver 420, processing circuitry 418 records information related to the theft signal as well as outputs an audible alarm. In accordance with FIG. 4, the security signal can be a diffused infrared signals or a RF signal. The theft signal can be a RF signal but not an infrared signal since an infrared signal can not penetrate the walls of inner office space 426. Those skilled in the art will recognize that the theft signal could be a diffused infrared signal if the external receiver was located in repair area 405. Communication between external receiver 420 and processing circuitry 418 and between the transmitter 404 and the processing circuitry can be any type of cable connection as well as a type of wireless connection.

Figure 5:
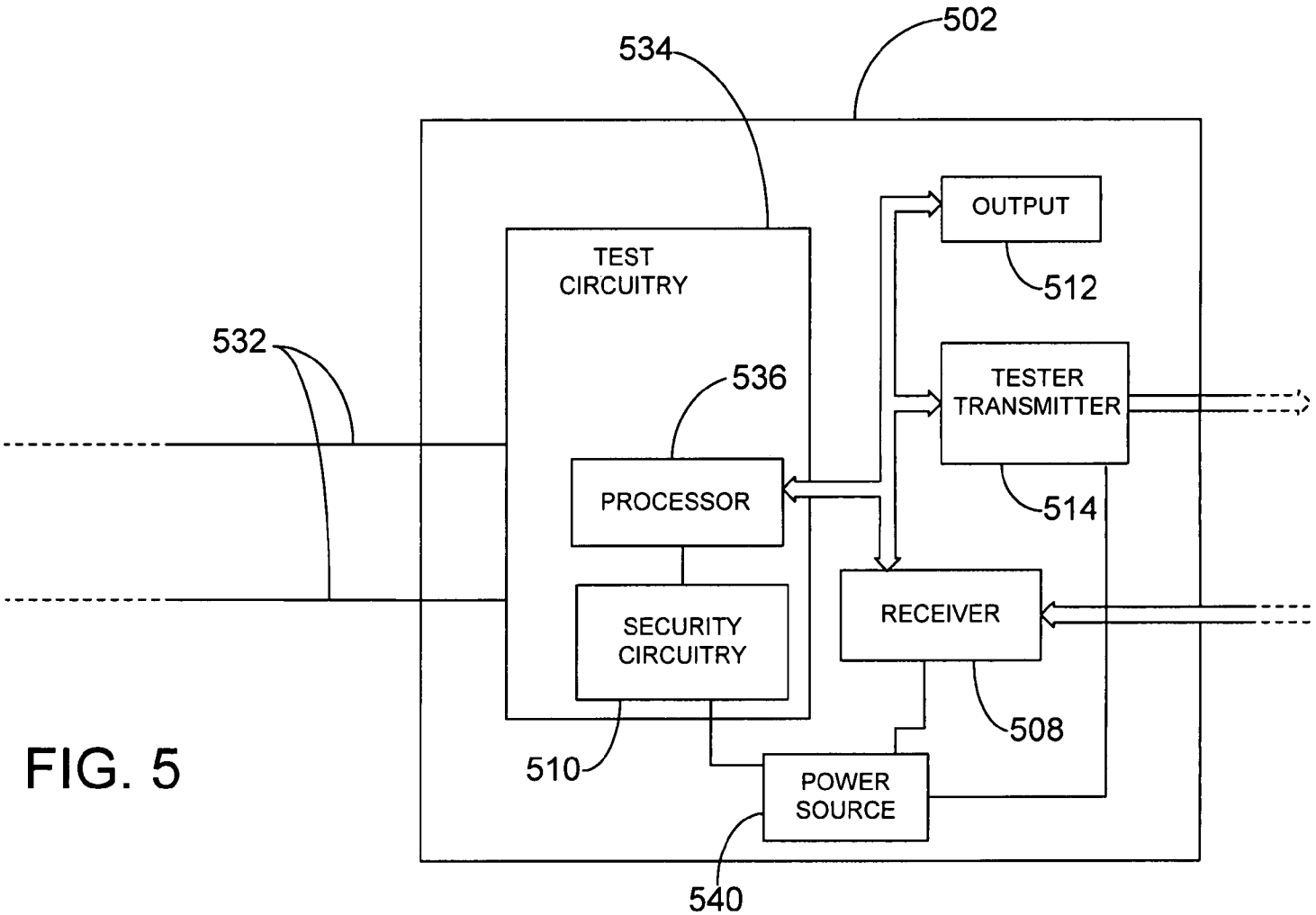
FIG. 5 is a simplified block diagram of an electronic battery tester in accordance with embodiment of the present invention.

FIG. 5 is a simplified block diagram of an example electronic battery tester 502 with which embodiments of the present invention are useful. Battery tester 502 is a type of portable tool which couples to a battery (not shown) via connectors 532. For example, connectors 532 may provide Kelvin connections to a battery. Note that FIG. 5 is illustrative of a specific type of battery tester which measures dynamic parameters. However, in one aspect, the present invention is applicable to any type of battery tester including those which do not use dynamic parameters. Other types of example testers include testers that conduct load tests, current based tests, voltage based tests, tests which apply various conditions or observe various performance parameters of a battery, etc.

Battery tester 502 includes test circuitry 534. Test circuitry 534 contains processor 536, security circuitry 518 and other circuitry configured to measure a dynamic parameter of a battery. As used herein, a dynamic parameter is one which is related to a signal having a time varying component. The signal can be either applied to or drawn from the battery.

Besides assisting in measuring dynamic and non-dynamic parameters of the battery, processor 536 also controls the operation of other components, such as theft prevention components, within battery tester 502. Battery tester 502 also includes output 512, tester transmitter 514 and receiver 508. Processor 536 controls the operation of these theft prevention components as well as carries out different battery testing functions. Battery tester 502 also includes internal power source 540. Generally, processor 536 draws its power from the battery being tested when in operation. However, battery tester 502 includes power source 540 such that processor 536 can control security circuitry 510, output 512, tester transmitter 514 and receiver 508 when battery tester 502 is not coupled to a battery being tested.

In some embodiments of the present invention, tool transmitter 514 is configured to transmit an infrared or RF signal and receiver 508 is configured to receive an infrared or RF signal. In this example, the theft prevention components rely on an internal power source 540 in order to complete the theft prevention operations as described in FIGS. 1–4. In other embodiments of the present invention, tool transmitter 514, receiver 508 and security circuitry 510 include a RFID tag. In this example, the theft prevention components rely on a reader to supply power in order to complete the theft prevention operations. Thus, no internal power source is needed.

Although the present invention has been described with reference to preferred embodiments, workers skilled in the art will recognize that changes may be made in form and detail without departing from the spirit and scope of the invention.

What is claimed is:

1. An apparatus for preventing theft in automotive vehicle service centers comprising:

a transmitter configured to transmit a wireless security signal which defines a perimeter, the transmitter including processing circuitry operably coupled to the transmitter and an external receiver operably coupled to the processing circuitry;

at least one battery tester for use in the automotive vehicle service centers comprising:

a receiver configured to receive the transmitted security signal; and security circuitry coupled to the receiver and configured to disable the battery tester if the battery tester is outside the perimeter defined by the security signal;

wherein the external receiver of the transmitter is also configured to receive a theft signal transmitted from the battery tester if the battery tester is outside the perimeter defined by the security signal.

2. The apparatus of claim 1, wherein the security signal comprises one of a diffused infrared signal and a radio frequency signal.

3. The apparatus of claim 2, wherein the radio frequency signal of the transmitter and the receiver incorporate a Bluetooth protocol.

4. The apparatus of claim 2, wherein the radio frequency signal of the transmitter and the receiver incorporate an 802.11b protocol.

5. The apparatus of claim 1, wherein the perimeter of the security signal is defined by a predetermined signal strength.

6. The apparatus of claim 5, wherein the battery tester is outside the perimeter if the security signal is less than the predetermined signal strength.

7. The apparatus of claim 6, wherein the security circuitry is configured to disable the battery tester if a predetermined period of time has elapsed since the battery tester was outside the perimeter defined by the security signal.

8. The apparatus of claim 1, wherein the battery tester further comprises an output operably coupled to the security circuitry, wherein the security circuitry is further configured to output a continuous audible noise if the battery tester is outside the perimeter defined by the security signal.

9. The apparatus of claim 1, wherein the battery tester further comprises a tool transmitter operably coupled to the security circuitry and configured to transmit a theft signal if the battery tester is outside the perimeter defined by the security signal.

10. The apparatus of claim 1, wherein the battery tester further comprises an internal power source configured to power the battery tester.

11. The apparatus of claim 1, wherein the receiver comprises an embedded radio frequency identification tag.

12. The apparatus of claim 1, wherein the external receiver and the transmitter comprise a radio frequency identification reader.

13. The apparatus of claim 1, wherein the processing circuitry further comprises a memory, wherein the processing circuitry is configured to record information related to the transmitted theft signal to the memory.

14. The apparatus of claim 1, wherein the processing circuitry is further configured to output an audible alarm when the processing circuitry receives the transmitted theft signal.

15. An apparatus for preventing theft in automotive vehicle service centers comprising:

at least one transmitter configured to transmit a wireless security signal which defines a perimeter;

at least one battery tester for use in the automotive vehicle service centers comprising:

a receiver configured to receive the transmitted security signal; and security circuitry coupled to the receiver and configured to disable the battery tester if the battery tester at least partially passes through the perimeter defined by the security signal.

16. The apparatus of claim 15, wherein the security signal comprises one of a direct infrared signal, a diffused infrared signal and a radio frequency signal.

17. The apparatus of claim 15, wherein the battery tester further comprises an output operably coupled to the security circuitry, wherein the security circuitry is further configured to output a continuous audible noise if the battery tester at least partially passes through the perimeter defined by the security signal.

18. The apparatus of claim 15 and further comprising processing circuitry operably coupled to the transmitter, the processing circuitry including an external receiver configured to receive a theft signal transmitted from the battery tester if the battery tester at least partially passes through the perimeter defined by the security signal.

19. The apparatus of claim 18, wherein the processing circuitry further comprises a memory, wherein the processing circuitry is configured to record information related to the transmitted theft signal to the memory.

20. The apparatus of claim 18, wherein the processing circuitry is further configured to sound an alarm when the processing circuitry receives the transmitted theft signal.

21. A method of preventing theft in automotive vehicle service centers, the method comprising:

transmitting a wireless security signal which defines a perimeter;

receiving the transmittal security signal with a receiver embedded in a battery tester for use in an automotive vehicle service center;

disabling the battery tester when the battery tester is outside the perimeter defined by the security signal; and receiving a theft signal transmitted from the battery tester when the battery tester is outside the perimeter defined by the security signal.

* * * * *